US008084662B2

(12) United States Patent
Vempati et al.

(10) Patent No.: US 8,084,662 B2
(45) Date of Patent: Dec. 27, 2011

(54) METHOD FOR DEGRADING CHEMICAL WARFARE AGENTS USING MN(VII) OXIDE WITH-AND-WITHOUT SOLID SUPPORT

(75) Inventors: Rajan K. Vempati, Plano, TX (US); Edward R. Biehl, Dallas, TX (US); Ramesh S. Hegde, Plano, TX (US); David Y. Son, Plano, TX (US)

(73) Assignee: ChK Group Inc., Plano, TX (US)

( * ) Notice: Subject to any disclaimer, the term of this patent is extended or adjusted under 35 U.S.C. 154(b) by 0 days.

(21) Appl. No.: 11/124,742

(22) Filed: May 9, 2005

(65) Prior Publication Data

US 2010/0010283 A1 Jan. 14, 2010

(51) Int. Cl.
*A62D 3/37* (2007.01)

(52) U.S. Cl. ..... 588/319; 588/313; 588/316; 588/320; 423/49

(58) Field of Classification Search ..... 588/313, 588/316, 319, 320; 423/49
See application file for complete search history.

(56) References Cited

U.S. PATENT DOCUMENTS

| | | | | |
|---|---|---|---|---|
| 4,867,796 | A | 9/1989 | Asmus et al. | 131/1 |
| 4,954,320 | A | 9/1990 | Birmingham et al. | 422/186.04 |
| 5,071,877 | A | 12/1991 | Bannard et al. | 514/640 |
| 5,075,297 | A | 12/1991 | Bannard et al. | 514/183 |
| 5,207,877 | A * | 5/1993 | Weinberg et al. | 423/210 |
| 5,434,336 | A | 7/1995 | Adams et al. | 588/203 |
| 5,678,243 | A | 10/1997 | Yang et al. | 588/200 |
| 5,705,078 | A * | 1/1998 | Kurek et al. | 210/759 |
| 5,760,089 | A | 6/1998 | Cronce | 514/643 |
| 5,859,064 | A | 1/1999 | Cronce | 514/643 |
| 5,922,926 | A | 7/1999 | Back et al. | 588/205 |
| 6,080,907 | A | 6/2000 | Miller | 588/202 |
| 6,121,506 | A | 9/2000 | Abel et al. | 588/200 |
| 6,143,088 | A | 11/2000 | Lion et al. | 134/2 |
| 6,369,288 | B1 | 4/2002 | Brown | 588/200 |
| 6,403,653 | B1 | 6/2002 | Hobson et al. | 514/759 |
| 6,410,603 | B1 | 6/2002 | Hobson et al. | 515/759 |
| 6,410,604 | B1 | 6/2002 | Braue, Jr. et al. | 514/749 |
| 6,417,236 | B1 | 7/2002 | Hobson et al. | 514/759 |
| 6,420,434 | B1 | 7/2002 | Braue, Jr. et al. | 514/759 |
| 6,437,005 | B1 * | 8/2002 | Hobson et al. | 514/759 |
| 6,455,014 | B1 | 9/2002 | Hammerstrom et al. | 422/186.04 |
| 6,472,437 | B1 | 10/2002 | Braue, Jr. et al. | 514/749 |
| 6,472,438 | B1 | 10/2002 | Braue, Jr. et al. | 514/759 |
| 6,537,382 | B1 | 3/2003 | Bartram et al. | 134/7 |
| 6,566,574 | B1 | 5/2003 | Tadros et al. | 588/200 |
| 6,570,048 | B1 | 5/2003 | Getman et al. | 588/200 |
| 6,589,673 | B1 * | 7/2003 | Kido et al. | 428/690 |

(Continued)

OTHER PUBLICATIONS

Chemistry: The Central Science, Brown et al., Prentice-Hall, Inc. 1997. p. 611.*
Merriam-Webster, Tenth Edition, 1999. p. 832.*

*Primary Examiner* — Jessica L Ward
*Assistant Examiner* — Paul Wartalowicz
(74) *Attorney, Agent, or Firm* — Charles D. Gunter, Jr.

(57) ABSTRACT

The invention provides a novel method of detoxifying highly toxic chemicals, and treating surfaces contaminated, or potentially contaminated, with toxic chemical agents such as chemical warfare agents and/or industrial toxins. The methods utilizes a novel sorbent compound which comprises Mn(VII) mineral which can be either solid supported or non-solid supported. The Mn(VII) mineral can be provided in a number of different forms including creams, lotions, powders, liquids, slurries and aerosols.

16 Claims, 3 Drawing Sheets

U.S. PATENT DOCUMENTS 6,596,915 B1 * 7/2003 Satyapal et al. ..... 588/313
6,953,763 B2 * 10/2005 Vempati et al. ..... 502/66
2004/0067159 A1 * 4/2004 Carnes et al. ..... 422/28
2004/0224836 A1 * 11/2004 Vempati et al. ..... 502/64
2005/0260257 A1 * 11/2005 Colic ..... 424/450

* cited by examiner

METHOD FOR DEGRADING CHEMICAL WARFARE AGENTS USING MN(VII) OXIDE WITH-AND-WITHOUT SOLID SUPPORT

BACKGROUND OF THE INVENTION

1. Field of the Invention

The present invention generally relates to reactive sorbents and methods of making and using the same for the decontamination of surfaces contaminated with highly toxic materials, including Chemical Warfare Agents ("CWAs") and/or Toxic Industrial Chemicals (TIC's), and the like, and for neutralizing such chemical and biological compounds or agents.

2. Description of the Prior Art

Chemical Warfare Agents (CWAs) typically classified as litter vesicants or nerve agents, pose a risk to both military personnel and to the population at large. Technologies for the safe disposal, facility and site cleanup and destruction of stockpiles are needed to protect the environment and the public. Additionally, the use of CWAs and Toxic Industrial Chemicals (TICs) by terrorists is a potential threat to the civilian population. Chemical and Biological Warfare Agents pose a risk to soldiers and to the civilian population. In the past three decades, CWAs have been used by the former Soviet Union army in Cambodia, Laos and Afghanistan (mycotoxins, yellow rain, tricothecene), by Iraq against Iran ((mustard gas (HD) and nerve agent (tabun)), and Iraq against its Kurdish dissidents (mustard gas (HD) and nerve agent (HCN)). Also, the use of Sarin gas by the Aum Shinrikyo cult, in 1995 was the first known terrorist attack against a civilian population resulting in some 12 deaths and 1,000 casualties.

Some 20 nations are suspected of possessing CWAs or have the means to make them. Representatives from more than 130 nations signed the final draft of the Chemical Weapons Convention in January of 1993, which outlaws the production, use, sale, and stockpiling of these chemicals and their means of delivery including the destruction of existing stocks by the year 2005. Thus far, about sixty of the signatory nations have ratified the treaty which entails the destruction of 25,000 tons and 50,000 tons of CWAs in the United States and former Soviet Union, respectively.

These chemicals are contained in bulk storage vessels, metal barrels, canisters, rockets, land mines, mortar and artillery shells, cartridges, and missiles. The projected costs for destruction of CWAs have been estimated at US$ 8 billion and US$ 10 billion, respectively, for the United States and the former Soviet Union alone. Operationally, chemical processing, as envisioned in the past, would frequently require handling and transferring of CWAs by human operators. Such handling operations could include, for example, removal of the CWAs from a warhead or missile casing, canister or other containerized delivery system, thereby exposing personnel to the grave danger of contact with the CWAs. Loading the CWAs so removed from a container into a separate reaction vessel would lead to another opportunity for exposure.

The CWAs can be classified into four main classes: 1) mustard gas, comprising: a) sulfur mustards (undistilled sulfur mustard (H), sulfur mustard (HD), and HD/agent T mixture (HT)); and b) nitrogen mustards (ethylbis(2-chloroethyl) amine (HN1), methylbis(2-chloroethyl)amine (HN2), tris(2-chloroethyl)amine (HN3), 2) Lewisites; and 3) four nerve agents (O-ethyl S(2-diisopropylamino)ethyl methylphosphonothioate (VX), tabun (GA), Sarin (GB), and Soman (GD), and 4) the blood agent cyanogens chloride (CK) (Munro et al., 1999).

Decontamination technologies for safe disposal, facility and site cleanup, and destruction of stockpiles are needed to protect the environment as well as the public. According to the Department of Defense, the developed technology should have following properties:

- Be an environmentally friendly product.
- Be capable of safe transportation, storage and handling including long term stability.
- Serve as a first responder to protect the civilian population.
- Be capable of restoring contaminated facilities.
- Be characterized as not affecting the operation of sensitive electronic equipment.
- Generate minimal toxic byproducts, and
- Rendering treated waste as being disposable in municipal waste.

An improved decontamination technology meeting the above listed guidelines would find immediate use in any number of existing CWAs and BWAs applications such as those listed below:

- CWAs stockpiles destruction.
- Improvements in soldier's clothing for protection against CWAs and BWAs; so as to provide greater flexibility/movement for the army to operate during terrorist attack.
- Gas masks for soldiers and civilian populations.
- The destruction of CWAs and TICs present in air, water, and soils.
- Protection of occupants in specially designed rooms to prevent deadly gas permeation.
- Degradation of ammunition wastes present at several Department of Defense (DoD) sites.
- Development of effective skin lotion decon against CWAs and BWAs.
- The development of CWAs and BWAs decon spray for contaminated interior spaces, vehicles, aircrafts, sensitive equipment, etc.
- Destruction of spores and pathogenic viruses.
- Construction of sensors to detect the presence of CWAs and BWAs, and
- Provision of water filtration units for drinking water supplies contaminated with CWAs.

Several CWA decontamination products and technologies exist, the efficiency of which depends upon environmental conditions as well as the mode of reaction. For purposes of the present discussion, the CWA protection and decon technologies which presently exist have been divided into the following categories: decon of interior spaces, therapeutic and protective skin lotions, CWA stockpile destruction, fabric for protection against CWAs and decon for BWAs. Each of these will be briefly discussed in order to better explain the environment of the present invention.

I. Decon for Interior Spaces, Sensitive Electronic Equipment, Vehicles, and Aircraft I.a. Adsobents and Catalysts:

The M100 Sorbent Decontamination System (SDS) replaced the original M11 and M13 Decon Apparatuses Portable (DAPs).

I.a.1. M100 or A-200-SiC-1005S:

This technology was developed by Guild Associates, Inc., and consists of alumina dust, carbon powder, $SiO_2$ and $Na_2O$. This is a fine dust, which may result in mild eye irritation and dermal allergy. Also, the dust particles may cause respiratory allergy with asthma symptoms (Guild Associates, Inc., MSDS sheet). The compound is an adsorbent and retains the CWAs in the pores, and ultimately degrades with time. It can be used for decontamination of the affected site, make a chemical protective barrier and decontaminant clothing and garments. There is no information as to how the contaminated A-200-SiC-1005S will be disposed of safely. The alkaline and alkaline earth metals are insulators consisting of metal oxides such as $Al_2O_3$ and MgO, which are generally considered to be acidic, and are generally used in cracking, polymerization, alkylation, isomerization, and hydration-dehydration reactions. The M100 SDS requires no water and is designed to operate at temperatures between −25 and 130° F., and is said to decontaminate a 12.5 $m^2$ surface contaminated with 10 g agent per $m^2$ surface in less than 15 minutes. Each M100 SDS consists of two 0.7 lb packs of reactive sorbent powder; two wash mitt-type sorbent applicators; case, straps, and instructions. An optional chemical agent resistant mounting bracket is also available.

I.a.2. Ag-Coated Zeolite

Bartram and Wagner (2003) were awarded U.S. Pat. No. 6,537,382 which teaches a novel method of detoxifying highly toxic chemicals and treating either surfaces contaminated or potentially contaminated with toxic chemical agents, such as, CWAs and/or industrial toxins. The method employs silver-exchanged zeolites (10% to about 40% wt/wt) and sodium zeolites as reactive sorbents to degrade CWAs or toxins on contact in solution or vapor form. However, the reaction with 2 chloroethyl ethyl sulfide results in generation of two irritants, e.g., divinyl sulfide and 1,4-thioxane. Slurries are taught which comprise a sorbent powder suspended in a compatible solvent hexane, fluorohydroethers, alcohols, ethers and combinations thereof. The destruction occurs in 1 minute to about 60 days, and at a temperature ranging from about −30 to 50° C. The application includes spraying, rubbing, brushing, dipping, blotting and dusting.

Ia.3. XE-555

Another decontamination material used as an alternative to DS2 is the relatively more expensive XE-555 resin (Ambergard™, Rohm & Haas Company, Philadelphia, Pa.). XE-555 is presently being used by the military for immediate decontamination applications. Although effective in removing chemical agents, it does not possess sufficient reactive properties to neutralize the toxic agent(s) picked up by this sorbent. Thus, after use for decontamination purposes, XE-555 itself presents an ongoing threat from off-gassing toxins and/or vapors mixed with the sorbent.

I.a.4. Metal Alloys

Back et al (1999) were granted U.S. Pat. No. 5,922,926 entitled, "Method and System for the Destruction of Heteroatom Organics Using at Least Two Metals Selected from Transition Metals, Alkaline Metal and/or Rare Earth Metals." A system is shown which decomposes or immobilizes organic wastes using a metal alloy agent comprised of at least two metals selected from transition metals, alkaline metal and/or and rare earth metals. The method first uses hydrogen and oxygen, with and without mechanical agitation, to decrepit and activate the metal alloy powders. Organic waste compounds are then introduced to the activated metal alloys. The reaction has to be performed under, vacuum of 50 millitorr or less, $H_2$ and air at 200° C. This method of decomposing organic materials effectively destroys organic compounds, which contain halogens, sulfur, phosphorous, oxygen, and higher order bonds. Working examples, given in the patent, utilize various metal alloys, a halogenated organic compound, i.e. chloroform, a double-bond containing compound, i.e. stearic acid, and CWAs' simulants dimethyl methyl-phosphonate and 2,2'-thiodiethanol, which contains the heteroatom phosphorous and sulfur, respectively, in accordance with the present invention. These examples are illustrative of the expected conversions and properties of the hetero-atom (e.g., Cl atoms in chloroform) P atom in dimethyl methylphosphonate, S atom in 2,2'-thiodiethanol) and higher-order bond (e.g., double bond in stearic acid) organic compound decomposition. Accordingly, the decomposition and/or immobilization ability of the metal alloys toward stearic acid and dimethyl methyl-phosphonate show the utility of other unsaturated compounds such as ethylene's and benzene's, as well as nerve agents such as Sarin. Similarly, the decomposition capability of the metal alloys toward chloroform demonstrates utility for the materials to decompose or immobilize other compounds containing halogens such as F, Cl, I, and Br (e.g., mustard gas, $S(CH_2CH_2Cl)_2$, and other halogenated solvents. Transition metals such as Fe, Pt, Pd, and Ag can chemisorb oxygen and hydrogen and are generally used in hydrogenation and dehydrogenation reactions. Another category is semiconductors, consisting of compounds such as NiO, ZnO, $TiO_2$, and $V_2O_5$. The catalytic capabilities of the semiconductor catalysts are well-known. Replacements for precious metal catalysts are also being developed, some comprised of nanoscale powders including iron, iron sulfide, and molybdenum disulfide.

I.b. Hydrolysis Products

Ia.b.1. Modec Decon Formulation MDF 200:

This product was developed by Tadros and Tucker (2003) of the Sandia National Laboratories. The product, which is in aqueous form, can be used to decontaminate chemical and biological agents (U.S. Pat. No. 6,566,574). This product can be incorporated into foam, spray and fog and the technology used for civilian and military first responders for open and closed spaces and to sensitive equipment. The chemical agents that it is most effective against include GD, HD and VX. The formulation is prepared using three mixtures in a given proportion: i) Mixture 1 contains n-Tallow pentamethyl propane, quaternary ammonium compound and benzyl C-12-18 alkyl dimethyl, isopropyl alcohol, and an inert ingredient and water, ii) Mixture 2 contains hydrogen peroxide, inert ingredient and water and iii) Mixture 3 is propylene glycol diacolate.

All the three mixtures are potential skin, eyes and inhalation irritants, and thermal combustion will cause emission of toxic fumes including nitrous oxide and ammonium vapors, and the $O_2$ released from $H_2O_2$ will further support combustion. In case of spill the Mixtures 1 and 2 have to be disposed into permitted landfill; whereas, Mixture 3 has to be incinerated.

MDF 200 reacts with GD to form the byproducts methylphosphonic acid (MPA), pinacolyl methylphosphonic acid, and with VX forms ethyl methyl phosphonic acid and MPA. The product also has the capability to destroy anthrax, *Yersinis pestis* (plague worm) and *Aflatoxin mycotoxin* within 15 minutes of contact time.

I.b.2. Quaternary Ammonium Complex:

Cronce et al. (1989, 1999) were awarded U.S. Pat. Nos. 5,760,089 and 5,859,064 for proposing a decontamination solution comprising about 30-45% of a quaternary ammonium complex containing benzyltrimethylammonium chloride and benzyltriethylammonium chloride dissolved in a solvent, such as water or glycol. This solution is stated to be a non-corrosive, nontoxic and nonflammable decontaminant, which may also be used to neutralize organophosphorus agricultural chemicals. However, there are limitations for the use of quaternary ammonium salts or quats because of their toxicity. For example, according to Ellenhorn et al. (1997), an oral dose of 100 to 400 mg $L^{-1}$ or a parenteral dose of 5 to 15 mg $L^{-1}$ is fatal to human beings.

Further Limitations Imposed By Quaternary Ammonium Compound Toxicity: Quaternary ammonium compounds can cause toxic effect by all routes of exposure including inhalation, ingestion, dermal application and irrigation of body cavities. Exposure to diluted concentration of quats can cause mild and self-limited irritation; however, concentrated solutions of these compounds are corrosive and can cause burns to the skin and the mucous membranes. They can produce neuro-toxicity due to their curare-like properties or produce allergic reactions. There have been infrequent reports of haemolysis and methaemoglobinemiain in the literature. Other clinical symptoms may include: nausea, vomiting, abdominal pain, anxiety, restlessness, coma, convulsions, hypotension, cyanosis and apnoea due to respiratory muscle paralysis; death may occur within 1 to 3 hours after ingestion of concentrated solutions. Quats may be unsafe for the environment both when they are manufactured and when they are discharged into the waste stream. They are not readily biodegradable. Swisher in 1991 reported 40 to 80 ppb for the Ohio River and 10 to 40 ppb in other U.S. rivers for dialkyldimethyl quaternary ammonium compound.

I.b.3. Decontamination Solution 2 (DS 2):

This solution is also useful against a variety of agents and contains 70% diethylenetriamine, 28% ethylene glycol monomethyl ether and 2% sodium hydroxide. However, DS2 will spontaneously ignite upon contact with hypochlorites and hypochlorite-based decontaminants. Further, it may cause corrosion to aluminum, cadmium, tin, and zinc after prolonged contact, and softens and removes paint.

I.b.4. Water Hydrolysis:

Yang et al. (1997) were awarded U.S. Pat. No. 5,678,243 for the detoxification or decontamination of aminoalkyl phosphonothiolates and more particularly, the chemical warfare agent VX and its analogs. The process involves adding water to the chemical agent so that hydrolysis reaction of the chemical agent with water occurs at specified molar ratios. In a preferred embodiment, the detoxification process is carried out in situ within the chemical agent storage containers in the field and includes mixing the contents of the container after adding the water. The mixing may be accomplished by shaking, rolling, tumbling or pumping and at 35° C. takes about 25 days to reduce the CWAs to 0.1% of the starting material. The degraded products EMPA and diisopropylaminoethanethiol, are relatively nontoxic.

I.c. Strong Oxidizers:

Strong oxidizers have been proposed for the destruction of CWAs and BWAs. Some of the technologies are listed below.

I.c.1. Peroxysulfate:

Getman et al. (2003) were award U.S. Pat. No. 6,570,048, describing a method to destroy organo-phosphorous compounds containing C—P chemical bonds, e.g., VX and GB nerve agents were oxidized with alkaline peroxysulfate to yield orthophosphates at the temperature range of 60 to 80° C. These compounds have the chemical formula of $M_2S_xO_y$ (V) in which M is a monovalent cation, e.g., peroxymonosulfate, peroxydisulfate, sodium peroxydisulfate or sodium persulfate and ammonium peroxymonosulfate. For example, phosphinates, including certain chemical warfare agents, as well as phosphinate salts produced by the solvated electron reduction of the chemical warfare agents are oxidized to orthophosphates. The process is preferably conducted in water at an alkaline pH.

I.c.2. Peroxygen:

Brown (2003) received U.S. Pat. No. 6,369,288 directed toward a method for using a chemical and biological warfare agent decontaminating solution having a peroxygen compound consisting of percarbonate, perborate and hydrogen-peroxide, and bleach activator forming peroxycarboxylic acid peracetate, perborate monohydrate, perborate tetrahydrate, monoperoxyphthalate, peroxymonosulfate, peroxydisulfate, percarbonate and hydrogen peroxide. The peroxygen compound and bleach activator, which consists of nonanoyloxybenzene sulfonate (NOBS), tetraacetylethylenediamine (TAED), lauroyloxybenzene sulfonate (LOBS) and decanoyloxybenzenecarboxylic acid (DOBA), are mixed in a surfactant system to generate a peroxycarboylic acid in-situ to detoxify warfare agents.

Limitations of This Oxidizer Type Technology: Strong oxidizers may be used to detoxify warfare agents; however, several problems exist with the use of the strong oxidizers. The reactivity of most strong oxidizers inhibit long shelf life of any decontaminating solution, tend to be corrosive, and are hazardous to humans and the environment. One type of strong oxidizer is the peroxycarboxylic acids or "peracids" (Abel) that do not possess most of the corrosive and hazardous characteristics; however, the peracids become unstable over short time periods, such as two or three months.

I.c.3. Super Topical Bleach (STB):

A hypochlorite-containing compound and Oxone (DuPont, Newark, Del.) composed of potassium peroxysulfate is known for decontamination of S-mustard, VX, GA and GB compound. However, hypochlorite formulations are very corrosive and toxic. Additionally, application of the hypochlorite decontaminant often requires substantial scrubbing for removal and destruction of the chemical warfare agent, a procedure which limits its use.

I.d. Microemulsion:

Seiders (1987) was awarded U.S. Pat. No. 6,610,977 directed toward a novel microemulsion containing sulfolane or 3-methylsulfolane or both as surfactants together with a cationic surfactant such as cetyl trimethylammonium bromide or a nonionic surfactant such as polyoxyethylene octylphenol ether. In another aspect of the invention, seawater may be substituted for the aqueous phase. The novel microemulsions are described as being useful for the detoxification of, e.g., pesticides and chemical warfare agents by enabling their improved removal and/or destruction through one or more of the processes of solubilization, oxidation or hydrolysis. The microemulsions are said to act not only in the speedy physical removal of contaminants but in their detoxification as well. Therefore, the sulfolane and/or 3-methylsulfolane containing microemulsions make possible speedier rates of solubilization, oxidation and hydrolysis of toxic chemicals used as chemical warfare agents. Moreover, the microemulsions (unlike alcohols) are not as susceptible to oxidation by hypohalites which are necessary to oxidize the contaminating species. Thus, the use of the microemulsions in conjunction with oxidants makes the speedier oxidation of contaminating species possible. Moreover, the lower volatility of sulfolane and/or 3-methylsulfolane containing microemulsions make them more suitable for use on hot equipment as against alcohol containing microemulsions because of the higher volatility of the usable alcohols. The lower volatility of the microemulsions in turn makes their use in the field safer because of diminished flammability hazards. Another such solvent mixture is CD-1 which contains 55 vol % monoethanolamine, 45 vol. % 2-hydroxy-1-propylamine and 2.5% by weight lithium hydroxide hydrate. However, both solvent mixtures impose difficult logistical burdens on their acquisition and transportation to the site of use in the field.

I.e. Photolysis:

U.S. Pat. No. 4,867,796 issued to Asmus and Boyer (1989) describes a method of removing a chemical contaminant from a surface by exposure of a contaminated surface to pulses of high-intensity, polychromatic, incoherent light radiation, such as is provided by powerful xenon flashlamps. The surface is exposed to one or more pulses of intense, broad-band frequency, incoherent light radiation, each pulse being delivered in about 10 milliseconds or less. The wavelength of the light radiation is between 380 nm to 720 nm.

Absorption of the radiation by the light-absorption agent results in the generation of heat localized in a very thin layer (1000° C.) which vaporizes and/or decomposes the contaminant on the surface. The distribution of absorption coefficients of the light-absorption agent is matched to the frequency or wavelength distribution of the pulsed light radiation, which is preferably predominantly in the visible spectrum. The absorption agent is applied to the surface, either subsequent to contamination or as an additive to the contaminant in anticipation of it contaminating surfaces, in amounts to deliver a neutral density of at least about 0.3, and the pulses have sufficient intensity to provide at least about 6 joules per $cm^2$ of surface area.

Sudan black is listed as a preferred light-absorption agent. Also, blue dyes, such as Nile blue and Red dyes are also radiation-absorbing, but less so. It was found that UV-absorbing dyes, such as paranitrobenzoic acid (PABA), are far less efficient absorbers of flash lamp radiation. Threat agents $C_2H_{16}PO_2F$ (GD), thickened GD (TGD), $C_4H_8Cl_2S$ (HD) and military chemical (EA 1699) were studied. In addition the following substances were evaluated: 2-chloroethyl ethylsulfide (a HD simulant), diisopropylfluorophosphonate (a GD simulant) and bis(-ethylhexyl)hydrogenphosphite (a military (VX) simulant). The agents and simulants were applied to various surfaces both with and without dye, and subjected to different types, intensities, and numbers of UV pulses. The effect of the irradiation on compound degradation was evaluated by monitoring the compounds concentrates on the substrate before and after pulsing. The conclusions of the Asmus and Boyer work were that: 1) the destruction of the CWAs was dependent on the substrate, and light observing material performed better, and 2) the heat generated by the short duration flash is localized at the material on the surface and at a very thin surface layer, and vaporization of the surface material dissipates the heat that is generated, whereby, the surface is substantially unaffected by the process. The destruction of the CWAs generates haze, and the composition of which is unknown. Another limitation is the fact that it is difficult or impossible to decontaminate using this technology in case the equipment or facility is contaminated.

I.f. Non-Thermal Plasma:

Non-thermal plasma is a technique in which electrons, rather than a gas, are excited. Ozone generators commonly use non-thermal plasma to produce ozone. Devices that produce non-thermal plasmas are often referred to as corona discharge generators. These devices generally operate by using very short duration, high voltage pulses (pulsed corona discharge) applied to an electrode. A corona discharge generator that employs a dielectric coating on the electrode is sometimes referred to as a barrier or silent corona discharge device. Tesla coils are often used as the high voltage source for a pulsed corona discharge; however, the pulsed corona discharge produced by a Tesla coil is often quite loud.

Recently, non-thermal plasmas have been used to remove pollutants from gas streams. U.S. Pat. No. 4,954,320 (Birmingham and Moore, 1990), entitled "Reactive Bed Plasma Air Purification", describes one such use of a non-thermal or corona discharge device used to detoxify a gas stream by passing the gas stream through non-thermal plasma. The reactive bed plasma device described therein produces active plasma, which yields energetic free electrons and highly reactive chemical species, especially oxygen atoms, to promote rapid oxidative decomposition of the contaminants in the air stream. This oxidation is similar to the process of incineration with the most notable difference being the dramatically reduced operating temperatures of the reactive bed plasma device. Electron impact is the driving force of plasma-induced decomposition because it creates more free electrons, ions, reactive neutrals, and radicals. Another result of direct energy input at the quantum level is the emission of ultraviolet light from nitrogen molecules in the surrounding air. This ultraviolet radiation is capable of breaking some chemical bonds, ionizing many compounds, and disinfecting selected biological contaminants upon prolonged exposure.

II. Fabric Blend or Detergent:

The technologies discussed below have the capability to be incorporated into fabric to protect against CWAs and TICs.

II.a. M291 Kit:

M291 kit, is a solid sorbent system (Yang, 1995) used to wipe bulk liquid agent from the skin and is composed of non-woven fiber pads filled with a resin mixture. The resin is made of a sorptive material based on styrene/divinylbenzene and a high surface area carbonized macroreticular styrene/divinylbenzene resin, cation-exchange sites (sulfonic acid groups), and anion-exchange sites (tetraalkylammonium hydroxide groups). The sorptive resin can absorb liquid agents and the reactive resins are intended to promote hydrolysis of the reactions. However, a recent NMR study has shown neither VX nor a mustard simulant were hydrolyzed on the XE-555 resin surface during the first 10 days (Leslie et al., 1991). GD slowly hydrolyzed with a half-life of about 30 hours. The observed rapid agent decontamination in the field is achieved physically by wiping. This resin blend was found to be less corrosive to the skin than the M258 system.

II.b. Bleach:

Bleach is used in the detergent for decolorization of stains. Bleaching agents irreversibly oxidize and decolorize bleachable soils present on fabrics. One type of bleaching agent contains peroxygen atoms, such as sodium perborate tetrahydrate ($NaBO_4.4H_2O$) and sodium perborate monohydrate ($NaBO_4.4H_2O$). These peroxygen compounds contain two linked oxygen atoms (—O—O—) that provide active or free oxygen when the link is broken. Peroxygen bleaches are known as being effective for stain and soil removal from fabrics. Detergent compositions also use bleaching agents to form peroxycarboxylic acids from bleaching activators. These detergent compositions generally contain approximately 0.03% bleaching agents and bleach activator during wash.

II.c. Nanophase MgO:

Rajagopalan et al. (2002) studied the interaction of nanophase Mg oxide (NMO), an ultrafine powder with high surface areas coupled with reactive sites, with organophosphates, e.g., $(CH_3CH_2O)_2$—$P(O)OC_6H_4NO_2$ (paraoxon), $(CH_3CH_2O)_2P(O)F$ (DFP), and $(CH_3CH_2O)_2P(O)CH_2$—$SC_6H_5$ (DEPTMP) at room temperature and under purged $N_2$ to remove $O_2$ from the reaction chamber. The reactive acids are ion vacancies, and electron-deficient and electron rich sites (Lewis acid and base sites) are present at the edge/corners. Solid state NMR and IR spectroscopy indicate the destructive cleavage of the organophosphate in that the OR and F groups dissociate. On the other hand, —PO4, —F and —OR groups are bound to the surface and in case of paraoxon and DEPTMP results in non-disassociation of —O—$C_6H_4NO_2$ and the P—$CH_2SC_6H_5$, respectively.

Wagner et al. (1999) studied the reaction of CEES with nanophase MgO and concluded that the result was hydrolyzed to thiodiglycol and divinyl sulfide, which are irritants. Further limitations of this technology for CWAs are: 1) the fact that high temperature process and vacuum are essential for manufacturing, 2) incomplete breakdown of organophosphates was achieved; hence, the toxicity of byproducts of surety chemicals need to be evaluated, and 3) the essential requirement to store at ambient atmosphere for an extended time. The research appears to have been performed in inert atmosphere (absence of $O_2$ and water) which may be critical for a real world situation. Therefore, its application in protective gear may not be applicable.

II.d. $SiO_2$ and $\alpha$-$Fe_2O_3$:

Henderson et al. (1986) studied the interaction of dimethyl methylphosphonate (DMMP) with $SiO_2$ and $\alpha$-$Fe_2O_3$ using temperature, the programmed desorption (TPD). There was no decomposition of DMMP on the dehydrated $SiO_2$ surfaces even at 400 K. In case of $\alpha$-$Fe_2O_3$ interaction with DMMP, at various temperatures following products were observed: HCOOH at 550 K; $CO_2$, CO and $H_2$ at 586 K and $CH_3OH$ and $H_2O$ at 600 K. At a temperature <250 K decomposition of P—$CH_3$ bonds were initiated by lattice $O_2$ and at a temperature >600K C-free phosphorus-containing residue was observed. However, the adsorption of P on the surface did not inhibit DMMP decomposition suggesting the migration of phosphate species below the surface. The limitations of this technology are: 1) energy intensive synthesis of $\alpha$-$Fe_2O_3$; and 2) degradation of DMMP at temperature ≧550 K severely restricts its use in protective gear.

II.e. Aluminum Oxide and Lanthanum Oxide:

Similarly, when DMMP was tested with aluminum oxide and lanthanum oxide, the P═O species were initially bounded to the surface at acid sites. Subsequently, elimination of a methoxy group was observed at 50° C. resulting in the formation of methanol. The final surface product observed by diffuse reflectance infrared spectroscopy was the surface-bound methylphosphate group (P—$CH_3$), which is resistance to further oxidation up to 400° C. (Mitchell et al., 1997). Testing selected nerve agents VX, GB, and GD with nanophase aluminum oxide resulted in formation of non toxic phosphonates at the surface and core of the material (Wagner et al., 2001). The reaction with HD resulted in the formation of thiodiglycol and minor amount of Chlorohydrin and thiodiglycol (CH-TG) sulfonium ions.

II.f. Nanophase CaO:

Wagner et al. (2000) studied the reaction of VX, GD and HD with nanophase CaO. The reaction with VX and GD resulted in formation of EMPA. In the case of the nanophase CaO reaction with CEES, the hydrolysis predominates over dehalogenation.

III. Chemical Stockpile Destruction Technologies:

III.a. Incineration:

Over the years a number of studies have designated incineration as the preferred method of destruction for CWAs because of the perceived low cost and relative simplicity of incineration technology. However, it is becoming clear that the incineration of chemical warfare agents poses risks of both an immediate and long-term nature, which may not be acceptable to the population. Public health and ecosystem integrity are threatened by the emission of materials, which can escape the combustion train, resulting in uncharacterized products of incomplete combustion becoming dispersed into the atmosphere. For example, the U.S. Army had to shut down its first domestic CWAs destruction facility in Tooele, Utah in less than three days after start-up. The nerve agent Sarin was detected in an area outside the chamber in which Sarin-filled rockets were being destroyed. Earlier public opposition to incineration had forced U.S. government authorities to consider alternative methods, including chemical treatment of the CWAs, capable of leading to environmentally neutral products. However, this concept was dismissed in the United States after publication in 1984 of a National Research Council report stating that, when compared to incineration, chemical neutralization processes are slow, complicated, produce excessive quantities of waste that cannot be certified to be free of harmful agents, and would require higher capital and operating cost.

Alternatives to incineration are cited, for example, in the table of contents from the "Proceedings, Workshop on Advances in Alternative Demilitarization Technologies," held in Reston, Va. USA on Sep. 25-27, 1995. Technical papers were presented which relate to molten salt oxidation, supercritical water oxidation, electrochemical oxidation, neutralization, hydrolysis, biodegradation, steam-reforming, and other technologies. However, the treatments were not universally applicable. It should be recognized that most chemical reagents are species-specific; that is, a chemical reagent generally reacts with a substance having a certain specific functional group. An acid reacts with a base, much less commonly with another acid. An oxidizing agent reacts with an oxidizable substance, such as a reducing agent. With such species-specific chemistry, destruction of a CWAs would require one to first establish the identity of the CWAs or the mixture of CWAs' to be destroyed in order to select the right reagent or combination of reagents to react with that particular material.

In principle, incineration is an attractive option as the CWAs destruction produces water, carbon dioxide and inorganic salts (ideally). However, incineration is turning out to be less than the anticipated panacea because of release of some of the CWAs to the environment.

III.b. Solvated Electrons:

Miller (2000) was awarded U.S. Pat. No. 6,080,907 for a method of cutting structural shapes by impinging a high pressure jet of anhydrous liquid ammonia or anhydrous ammonia-abrasive mixture at high impact velocity at a target substrate for faster, more efficient cutting/penetration rates i.e., up to 25 percent improvement over high pressure jet cutting methods with water as the cutting fluid. This method provides greater safety and flexibility, particularly in demilitarizing munitions comprising energetic materials and/or chemical warfare agents. The energy from the cutting jet comprising anhydrous ammonia may also be utilized in a continuous, uninterrupted sequence of processing steps after penetrating a closed casing for dispersing/dissolving and washing out the contents from the penetrated containment for further processing. The methods include treating the slurries comprising the removed hazardous substances with solvated electrons, i.e., Na metal or ammonia, to chemically reduce and destroy virtually any hazardous or toxic substance, and particularly chemical warfare agents and energetic materials in a confined reactor. This may not be able practical for developing a portable decontamination for interior spaces.

III.c. Detonation:

Adams et al. (1995) were awarded U.S. Pat. No. 5,434,336 for a detonation process for stabilizing energetics, including explosives, e.g., 3,5-trinitro-1,3,5-triazacyclohexane (RDX), 1,3,5,7-tetranitro-1,3,5,7-tetraazacyclooctane (HMX), 2,4,6-trinitrotoluene (2,4,6-TNT), and pentaerythritol tetranitrate (PETN). These compounds were chosen to represent nitramine, nitroaromatic, and nitrate ester explosives. Also, propellants, pyrotechnics, e.g., fireworks, road flares, smoke grenades, riot control tear gases and chemical warfare agents including both the vesicants and nerve agents, and obsolete munitions were stabilized below detonation temperature by reaction with liquid sulfur in absence of air and temperature <110° C. Also disclosed is the method of introducing sulfur into explosive packages without dismantling the package. The package is soaked in carbon disulfide solution and evaporated to form elemental sulfur. After stabilization below the autodetonation temperature, the reaction products are completely destroyed by reaction with sulfur vapor at temperatures >500° C. The destruction of explosive lead to the formation of gaseous product identified as nitrogen dioxide, nitrous oxide, carbon dioxide, sulfur dioxide, and water. A brown colored gas, later determined to be a mixture of NO. This appears to be similar to incineration process and needs sophisticated equipment for destruction.

IV. Skin Lotions

An acceptable decon skin location should have following properties: 1) safe transportation, storage and handling including long term stability, 2) useful for first responders to protect the civilian population, 2) restore the contaminated facility, 3) generate minimal toxic byproducts, and 4) the treated waste disposable in municipal landfill and domestic wastewater sewers. These types of decontaminants are broadly classified into two categories: 1) skin barrier lotion, and 2) reactive skin decon or decontamination lotion.

IV.a. Skin Exposure Reduction Paste Against Chemical Warfare Agents (SERPACWA):

SERPACWA is a barrier paste consisting of base chemicals, perfluoroalkylpolyether (PFPE) and polytetrafluoroethylene (PTFE). It acts as a physical barrier that prevents or delays the human skin exposure to chemical/biological warfare agents. This has been demonstrated through controlled laboratory and in vivo studies in animals using blister agents such as sulfur mustard (HD), nerve agents such as soman (GD and TGD) and VX, a skin necrosis agent, T-2 mycotoxin, and a lacrimating riot control gas, CS. Pretreatment with SERPACWA provides significant protection against four-hour challenges with HD, T-2 toxin, Soman (GD) and VX. Furthermore, from the NMR analysis of urine samples of persons exposed to SERPACWA, four hours daily for two consecutive days, no detectable levels of either organic or inorganic fluorine has been found, thereby indicating that there is no systemic absorption of the material through human skin.

Even though interaction between SERPACWA and a skin decontaminating kit has not been completely characterized, it has been found that in animals, the protection provided by a SERPACWA-like product and the M291 Skin Decontaminating Kit (SDK) was better than that provided by M291 alone. Based on these and other trials, its human use was recommended only in conjunction with Mission Oriented Protective Posture (MOPP) gear. For military uses, it is supplied in 84-gram pouches, each pouch sufficient for one application per subject.

Limitations of this technology: These are only barrier creams; they are not reactive; and there is a potential risk to the subject due to "polymer fume fever" syndrome if used when not under imminent CWAs threat.

IV.b. Reactive Topical Skin Protectant (RTS):

This product consists of a base cream, i.e., PFPE and PTFE and reactive moieties. The active moiety is added to the base slow or vigorous agitation by manual or mechanical means. There are two factors to be taken into account: 1) the active moiety should not react with the base cream, and 2) neutralize CWAs in the base cream environment. Several moieties have been tested including S 330 (1,3,4,6-tetrachloro-7,8-diimino glycouril), iodobenzene diacetate (IBDA), dendrimers, XE-555, polysilsesquioxanes and inorganic compounds against HD and inorganic oxides, metal precipitates and dendrimers against GD (See Hobson, et al., 2002a,b,c,d; Braue et al., 2002a,b,c,d).

IV.c. M291 Skin Decontamination Kit (SDK):

M291 SDK, a reactive decon skin lotion, is a non-proprietary formulation containing 33% C sold by Ambergard™, Rohm & Haas Company, Philadelphia, Pa. It is composed of carbon and XE-555 resin (i.e., a strong base anion exchange polymer, hydroside ion and a strong acid cation exchange polymer hydrogine ion). M291 is presently being used by the military for immediate decontamination applications. Although effective in removing chemical agents, it does not possess sufficient reactive properties to neutralize the toxic agents picked up by this sorbent. Thus, after use for decontamination purposes, XE-555 itself presents an ongoing threat from off-gassing toxins and/or vapors mixed with the sorbent.

IV.d. Commercially Available Reactive Skin Decontaminant Lotion (RSDL):

Studies conducted by the U.S. Army on this lotion have demonstrated that its reaction with chemical and biological agents (CBW) is rapid (≦2 minutes) and complete, neutralizing the CBW agents and producing non-toxic products. It is also found to be safe when applied on the skin, even without exposure to CBW agents (Bide et al., 1993). RSDL has been extensively used in the war zone worldwide by the Canadian Forces, the Netherlands Armed Forces (OPCW), and the Australian Armed Forces. UNSCOM destruction verification missions in Iraq, in the former Yugoslavia, and other programs associated with several national heads of state and Special Forces, have used RSDL to their benefits. RSDL is manufactured by O'Dell Engineering Ltd., Ontario, Canada, and is available in both pouch (21 ml and 45 ml sizes) and bulk bottle (500 ml) forms. E-Z-EM has estimated that the product, packaged in a pouch that can treat one person, would cost roughly $20 to $22 per pouch. The decontamination lotion is not effective after prolonged exposure (greater than a week) to air, necessitating the disposal of opened pouches of lotion regardless of the extent of previous usage. The decontamination lotion should also not come into contact with the charcoal/foam liner of the CW protective suit.

IV.e. Reactive Skin Decontamination Lotion (RSDL) Technology Generally:

Bannard et al. (1991a,b) are co-inventors of the RSDL and were issued U.S. Pat. Nos. 5,071,877 and 5,075,297 for their discovery relating to a cream or lotion. U.S. Pat. No. 5,071,877 describes a product having at least one active ingredient chosen from the alkali metal salts of certain oximes, phenols or polyethylene glycol monoethers which is dispersed in a substantially anhydrous state in a base medium comprising of polyethylene glycol(s) which have optionally been at least partially etherified to reduce the free hydroxyl group content thereof. These creams or lotions are effective against chemical warfare agents of both the VX and G types, and against mustard gas (H or HD), and are simpler to make than the known potassium salt-containing creams such as those containing a macrocyclic ether and/or inert thickener and potassium phenate. These creams or lotions may be used both for protection and decontamination, and some may be used as personal barrier creams. The compound tested were vesicant class of chemical warfare agents.

The preparation of these formulations requires specialized equipment including the reflux apparatus, dry box or inert air chamber flushed with Ar or $N_2$ gas; whereas, the preparation of potassium phenoxide, potassium 2,3-butanedione monoximate and potassium acetophenone oximate is complicated by the need for high vacuum and long preparation time (duration two days to 7 days).

U.S. Pat. No. 5,075,297 is somewhat similar to the above protective barrier cream against CWAs protection. The formulation consists of at least one alkali metal salt of phenol, acetone oxime, acetophenone oxime and 2,3-butanedione monoxime, a macrocycle chosen from 18-crown-6 or cryptand [2,2,2] and a solvent chosen from dioxolane, tetraglyme, dimethoxyethane, a polyethylene glycol or a polyethylene glycol mono- or diether. The system also contains just enough water to dissolve the active ingredient. This lotion also affords protection against mustard gas (H or HD) and against chemical warfare agents of the VX and G types.

RSDL is a decon which is effective against mustard, G and VX agents but appears to be less effective against Lewisite and tests are being conducted against biological agents. The product cannot be used in case the user had wounds or is allergic to cosmetics. This product decomposes at <200° C. to form CO and/or $CO_2$. The material is a fire hazard in the presence of ignition sources, has to be stored between 100 and 30° C., and cannot be exposed to air for several hours as this will reduce the effectiveness.

Possible Shortcoming of the Skin Lotion Technologies Generally: There are a number of problems with the above described systems. To be effective against any CWAs, a skin lotion cream has to exhibit three main properties: 1) be effective against all types of chemical warfare agents, 2) be compatible with human skin and not cause any adverse reactions, at least over a limited period of time, 3) the material should be easy to wash off and leave residue on the skin, and 4) the material should provide protection to the wearer for a reasonable period of time. The chief difficulty is that such decontamination systems contain reagents which cannot be tolerated on human skin for any more than quite brief periods of time. Some of these systems are very alkaline, and some use concentrated active chlorine, and/or bleach solutions. Thus, although these systems are more or less effective as decontaminants for equipment which has been exposed to chemical warfare agents, they are of little use in protecting people, and give no guide at all to the sort of reagents that may be used for this purpose.

V. Biological Warfare Agents Decontamination Technologies (BWA):

Following technologies are available for BWAs:

V.a. Gas-Based Biological Warfare Agent Technologies:

Ozone, chlorine dioxide, ethylene oxide, $H_2O_2$, and paraformaldehyde have all been investigated for decontamination applications. These are all known to be effective against biological warfare agents. The effectiveness of ozone for killing spores appears to be well established (Raber et al., 1998). While ozone is an attractive decontaminant, experiments by Edgewood Chemical Biological Center (ECBC) show that it is not effective towards GD and with VX it leads to the formation of toxic products via P—O bond cleavage (Hovanec et al., 1998).

V.b. M100 or A-200-SiC-1005S:

This technology was developed by Guild Associates, Inc. consisting of alumina dust, carbon powder, $SiO_2$ and $Na_2O$ and was described previously under Section I.a.1. The compound is an adsorbent and retains the CWAs in the pores, and ultimately degrades with time (kinetics not mentioned). It can be used for decontamination of the affected site, make a chemical protective barrier and decontaminant clothing and garments. There is no information as to how the contaminated A-200-SiC-1005S will be disposed of safely.

V.c. Modec Decon Formulation MDF 200:

This technology was developed by Tadros and Tucker (2003) of the Sandia National Laboratories and was previously described under Section I.a.b.1. above. The chemical agents that it is most effective against include GD, HD and VX. The formulation is prepared using three mixtures in a given proportion: i) Mixture 1 contains n-Tallow pentamethyl propane, quaternary ammonium compound and benzyl C-12-18 alkyl dimethyl, isopropyl alcohol, and inert ingredient and water, ii) Mixture 2 contains hydrogen peroxide, inert ingredient and water and iii) Mixture 3 is propylene glycol diacolate. Quaternary ammonium compounds are toxic to human being as they can produce neuro-toxicity due to their curare-like properties or produce allergic reactions. Further they are non-biodegradable.

V.d. Super Topical Bleach (STB):

This formulation consists of a hypochlorite-containing compound and Oxone (DuPont, Newark, Del.) comprised of potassium peroxysulfate and is known for decontamination of S-mustard, VX, GA and GB compound. However, hypochlorite formulations are very corrosive and toxic. Additionally, application of the hypochlorite decontaminant often requires substantial scrubbing for removal and destruction of the chemical warfare agent, a procedure which limits its use.

V.e. Biological Warfare Agents Cell Composition and Method of Decontamination:

There are several mechanisms generally recognized for spore kill. These mechanisms can operate singularly or simultaneously. In one mechanism, the dissolution or chemical disruption of the outer spore coat can allow penetration of oxidants into the interior of the spore. Several studies (King and Gould, 1969; Gould et al., 1970) suggest that the —S—S- (disulfide) rich spore coat protein forms a structure which successfully masks oxidant-reactive sites. Reagents that disrupt hydrogen and S—S bonds increase the sensitivity of spores to oxidants. Peptidoglycan, which is loosely cross-linked and electronegative, makes up the cortex of a spore. In another mechanism, cationic interaction between a disinfectant solution and peptidoglycan can cause collapse of the cortex and loss of resistance.

The peptidoglycan of spore-forming bacteria contains teichoic acids (i.e., polymers of glycerol or ribitol joined by phosphate groups). In another decontamination mechanism, disruption of the teichoic acid polymers can cause deficiencies in the peptidoglycan structure making the spore susceptible to attack. Additionally, certain surfactants can increase the wetting potential of the spore coat to such an extent as to allow greater penetration of oxidants into the interior of the spore.

VI. Summary:

Most of the chemical methods discussed in the Background of the Invention which have been proposed for the destruction of chemical warfare agents are believed to have unacceptable capital requirements for equipment, facilities, and personnel safeguards, as well as requiring time-consuming, labor-intensive processing. Transportation, chemical stability and logistics are additional disadvantages. Furthermore, cost of disposing of the products after the CWAs and TICs destruction chemistry has to be factored. In light of all this, there is still need for an innovative technology that satisfies these existing requirements.

SUMMARY OF THE INVENTION

A method of decontaminating surfaces exposed to chemical warfare agent is shown which comprises contacting said surfaces with a sufficient amount of a reactive sorbent comprising Mn(VII) mineral. The Mn(VII) mineral can be either solid supported or non-solid supported. Exemplary chemical warfare agents include mustard gas, Sarin and G agents, Lewisites and cyanogen chloride. The Mn(VII) mineral can be prepared in a number of different forms including powders, liquids, slurries and aerosols. The Mn(VII) mineral can also be prepared in the form of a cream or lotion for application to the human epidermis.

The Mn(VII) mineral is preferably synthesized at a pH range from about 6.5 to 13.5. When the Mn(VII) mineral is solid supported, the solid support can be selected from among clays, synthetic and natural zeolites, nanoclays and inorganic and organic exchangers. The Mn(VII) mineral can be synthesized as a dried product with the dried product then being dispersed in an aqueous phase. The Mn(VII) mineral can also be synthesized as a dried product and the dried product subsequently dispersed in a non-aqueous phase such as alcohol. The Mn(VII) mineral can also be used to neutralize and/or destroy toxic industrial chemicals such as parathion, malathion, and related chemicals having lone pairs of electrons which can be withdrawn by Mn(VII) mineral.

Additional objects, features and advantages will be apparent in the written description which follows.

DETAILED DESCRIPTION OF THE INVENTION

The present invention provides novel sorbents and methods for preparing the same for decontaminating, neutralizing, removing and deactivating a wide range of highly toxic materials, including Chemical Warfare Agents (CWAs) and Toxic Industrial Chemicals (TICs)

In order to appreciate the scope of the invention, the terms "toxin," "toxic agent," and "toxic material," are intended to be equivalent, unless expressly stated to the contrary. Reference herein to a toxic agent is intended to encompass CWAs, including, e.g., toxic organophosphorus-type agents, mustard gas and derivatives, and similar such prior art toxins known in the relevant arts. In addition, unless otherwise stated, the term toxic agent as used herein is also intended to include toxic industrial chemicals, including, but not limited to, organophosphorus-type insecticides, and the like. In particular, the terms, "nerve gas," "nerve agent," "neurotoxic," and the like are intended to be equivalent, and to refer to a toxin that acts or manifests toxicity, at least in part, by disabling a component of an animal nervous system.

The methods provided by the invention employ reactive sorbents effective for removing and deactivating toxic agents, as defined herein. Reactive sorbents according to the invention include compositions that sorb, or take up toxic agents, and then deactivate at least a portion of the taken up toxic agent. Thus, the combination of the sorbent and toxic agent is rendered safer to handle after a period of time, relative to the combination of the same amount of toxin under the same conditions with an otherwise equivalent sorbent lacking reactive or degradative properties.

Figure 1:
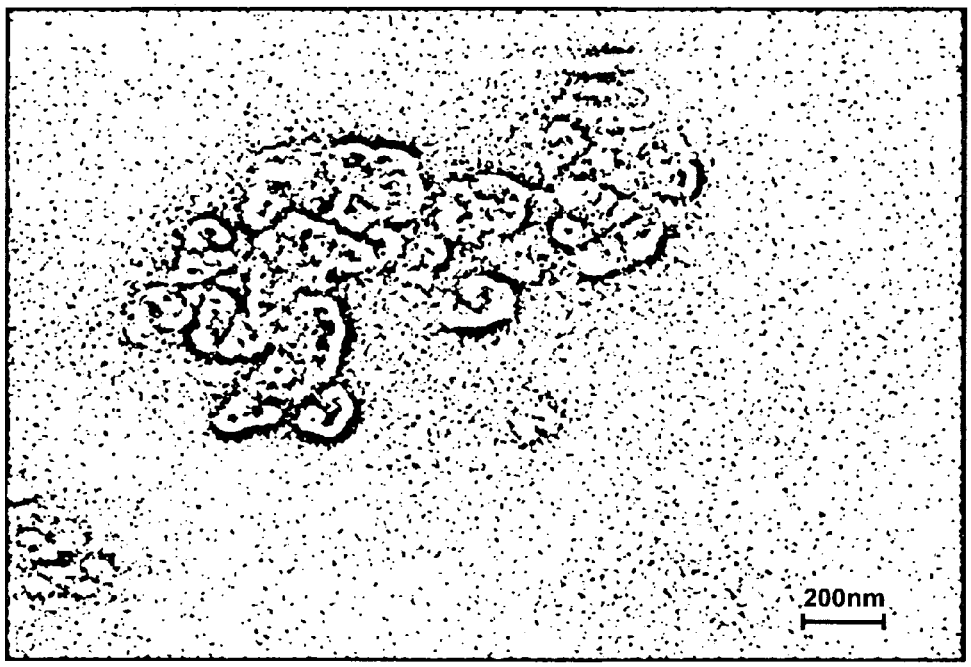
FIG. 1 is a scanning electromicrograph of the Mn(VII) of the invention with a scale bar of 200 nm being shown for reference.

The reactive sorbents employed in the methods of the invention are based on what will be referred to herein as "Mn mineral", a novel type of synthetically manufactured zeolite material. Manufacture of the Mn mineral is preferably accomplished as follows:

General Method of Mn(VII) Mineral Preparation:

Pure Mn(VII) oxide with and without solid support was synthesized at pH 7 to 13. The Mn(VI) mineral will be referred to Mn(VII) oxide with and without solid support. To a 250-mL glass beaker containing a magnetic bar, 18 g of $MnCl_2$ was dissolved in 100 mL of distilled water and placed on a magnetic stirrer. After 15 min, 50 g of bentonite clay or zeolite was added and the suspension equilibrated for 15 min. The previous step is avoided in case of pure Mn(VII) oxide synthesis. Then, the pH is raised to desired pH using NaOH, resulting in precipitation of Mn(II) mineral in presence or absence of solid support. After 30 min of equilibration, 1 g of 1,4-PDA was added and the temperature of the beaker was raised to 70° C.; following three hrs of stirring the suspension color changed to violet indicating the formation of Mn(VII) oxide. The material is either air dried at 150° C. overnight or left as slurry and stored in a container. The scanning electron microscope (SEM) images of the particles show that the particle size ranged from 50 nm to 100 nm (illustrated in FIG. 1).

Method of Preparing Solid Supported Mn(VII) Mineral:

Various "solid support materials" can be used whereby various oxidation states of Mn are stabilized on the solid phase. The following support materials were used to prepare the various stable (solid-supported) oxidation states of Mn:

(1). Hydrophobic ZSM-5 Materials:

Commercial H-ZSM-5: This is a hydrophobic zeolite purchased from Zeolyst International. The $SiO_2/Al_2O_3$ molar ratio is 40. The pore size of this zeolite is approximately 4 to 5 Å. Na-ZSM-5 was also manufactured by a template free process using rice hull ash as the starting material (Vempati, 2002). The Na-ZSM was converted to H-ZSM by a process discussed below.

(2). H-Saturated Support Material:

H-saturated zeolite and clay was prepared by shaking the zeolite or clay with 1 M $NH_4Cl$ solution (solid to solution ratio of 1:10) for 30 mins and filtering the suspension. This process was repeated thrice. The excess of salts was then washed with distilled water until it is $Cl^-$ free (tested with $AgNO_3$). The filtrate was dried in an oven at 500° C. for 4 hrs to produce the H-saturated support material.

Another H-saturated support material was prepared as follows: In a 2-L flask, one lb of zeobrite 1430S, was treated with 500 mL of 2N NaOH solution for one hr at 95° C. using a rotary evaporator. Then, the supernatant was decanted and the solid was dried at 180° C. for three hrs. The dried zeolite was treated with a Fe—Si—Mn mixture. The composition of the mixture was 200 mL of $FeCl_3$ (40% Fe) and 16 g of $MnCl_2$ and 24 g of $Na_2SiO_3$. The final volume of the mixture was brought up to 500 mL by adding 300 mL of distilled water. The resulting mixture was added to the dried zeolite and swirled using a rotary-evaporator for one hr at 95° C. Subsequently, the suspension was dried at 180° C. for four hrs. The coated sample was cooled, washed thoroughly with distilled water and dried at 180° C. for three hrs. The oxidation state of Mn in the Fe oxide substituted natural zeolite (FMNZ) is three (Vempati et al., 1995).

Synthesis of Mn(VII) Using Natural Zeolites:

As discussed further under the "Preparation" section below, the dried coated sample was treated with 2% 1.4 PDA solution for one hr at 70° C. to make Mn(VII) coated zeolite. The violet colored sample was washed of excess PDA using distilled water and dried at 100° C.

(3). Zeolite 13X:

Zeolite 13X is a hydrophilic zeolite purchased from PQ Corporation. The cation exchange capacity of this zeolite is 450 cmol $kg^{-1}$. The amount of Na present is 11%. The pore size of the zeolite is 8 to 9 Å.

(4). Clays:

L 10 Bentonite Clay (Ca-Saturated): This is montmorillonitic clay procured from Southern Clays, Gonzales, Tex. The amount of $Ca^{2+}$ present in the clay is 0.1%.

Preparation of Solid Supported Mn(VII):

Solid supported Mn(VII) was prepared as follows. A known amount of support material was added to a beaker containing Mn(II) solution and the suspension was equilibrated for 30 min by magnetic stirring. Then the pH was raised to 13.1 to form the Mn(IV) oxide, observed by a beige coloration of the suspension. It is essential to precipitate the Mn in its oxide forms; otherwise, the Mn(II) will not oxidize. These samples are referred to as supported Mn(IV) materials.

In the case of H-ZSM-5 and the Fe and Mn coated natural zeolite (FMNZ), the Mn(IV) was then reacted with 2% 1,4-PDA resulting in the formation of Mn(VII) (as observed by the developed violet color) within two hours. In contrast, Ca-clay supported Mn(IV) took 4 hrs to develop the violet color while Mn(IV) supported on Na-saturated zeolite 13X did not show any change. The amounts of Ca2+ and Na+ present in the exchangeable sites of the clay and zeolite 13X are 0.1% and 11%, respectively. When the amount of PDA was increased to 4%, the clay changed to a violet color in <15 minutes. For violet color formation in zeolite 13X, the PDA concentration had to be increased to 6%, with the color forming in 24 hrs. Likewise, Mn(IV) supported on Na-ZSM-5 prepared from rice hull ash (Vempati, 2002) containing only 1.11% Na, took <30 min for the formation of Mn(VII).

Mn(VII) oxide is a highly dispersed; therefore, to remove excess PDA and Na ions ultracentrifugation or dialysis is suggested. The reacted suspension is transferred into dialysis tubing until the water ceases to be colored and the electrical conductance is lowered significantly. The product can be air dried or freeze dried.

Applicant's studies have shown that the washed samples can be treated with 0.01 M HCl to remove $Na^+$ sorbed on the zeolite surfaces and dried at 100° C. overnight before use to improve the reactivity. The powdered samples can be stored in desiccators to prevent moisture sorption.

Mn Oxidation States and Color:

It is important for purposes of the present discussion in explaining the nature of the Mn(VII) mineral to differentiate between the various Mn oxidation states. One way to do this is in terms of the characteristic colors of the various states. In nature, Mn primarily exists as Mn(II) and Mn(IV), whereas Mn(III) and Mn(VII) tend to dis-proportionate into the above mentioned stable oxidation states. In minerals, a Mn(II) octahedral coordinate state is identified by its visible and near infrared absorption spectrum, consisting of a sharp band near 412 nm and two weak bands at longer wavelength (Rossman, 1988). There are several reports concerning the stabilization of various Mn oxidation states in solution but none on stabilization on the solid phase. In the chemical literature there are references of the predominant mineral colors due to Mn oxidation states. For example, octahedral Mn(II) in a mineral is pink but in tetrahedral sites it is a yellow-green color. Mn(III), when present in octahedral sites is either red/lavender or green/turquoise (Vempati et al., 1995). Mn(IV) minerals are brown to black and Mn(VII) is violet (Rossman,; Online, 2001).

There is little to no information in the literature regarding the stability of solid supported Mn(III) and Mn(VII). The following stabilized oxidation states of Mn have been observed in a study of clay and phenylenediamine (PDA) interactions. The studied clay was an expansive type (montmorillonite) mined from Gonzales, Tex. which contained Mn either in the structure and/or as Mn-oxide impurities. The percent Mn present in the clay was 0.25%. The various supported Mn oxidation states obtained were:

a). Mn(II): This was synthesized by adding 1,2-phenylenediamine dihydrochloride to the $MnO_2$ and/or Gonzalez clays. Color of the mineral: pink, red or lavender.

b). Mn(III): This was synthesized by adding 1,4-phenylenediamine dihydrochloride to $MnO_2$ and/or Gonzalez clays. Also, it can be prepared by bubbling ozone or adding $H_2O_2$ to a solution containing degraded PDA and Mn(VII)-coated material. Color of the mineral: green or turquoise.

c). Mn(IV): This is the original Mn oxidation state in Gonzalez clays. Color of the mineral: brown to black depending on crystallinity and amount of Mn(IV) present.

d). Mn(VII): This is synthesized by adding 1,4-phenylenediamine to $MnO_2$ and/or Gonzalez clays. Color of the mineral: violet.

Mixed Mn(III) and Mn(VI) oxides: This is synthesized by adding 1,4-phenylenediamine to Mn oxide coating solid support media and setting the pH in the range of 4.5 to 6.5. The color of the mineral is bluish green.

The fact that Applicants' suspension described under "Method of Mn(VII) Mineral Preparation" above changed to violet was therefore an indicator of the formation of Mn(VII) oxide.

Mechanism of Mn(VII) Mineral in Attacking Biological Warfare Agents:

The Background of the Invention contained a discussion of the various known mechanisms generally recognized to kill spores (see Section V.e., above). These mechanisms include disruption of the teichoic acid polymer production as well as chemical disruption of the outer spore coat to allow penetration of the oxidants to the interior of the spore. While not wishing to be limited to any particular theory of operation, Applicants' postulate that the presently discovered aqueous Mn(VII) mineral can disrupt/oxidize the —S—S— (disulfide) rich spore coat proteins by attaching to the lone pairs of electron. Also, some teichoic acids produced by certain bacteria contain monomers and dimmers of N-acetylglucosamine. In such cases, lone pairs of electrons can be withdrawn by the Mn(VII) minerals of the invention.

Mechanisms of Organic Compound Oxidation by the Mn(VII) Mineral:

The organic compounds containing lone pairs of electrons react on the surfaces of the Mn(VII) oxides probably at the Lewis acid sites; thereby, oxidizing the organic compound and reducing Mn(VII). This is further supported by the change in violet color of the Mn(VII) oxide to brown Mn(IV) oxide. $KMnO_4$ is effective but only in polar solvents, e.g., $H_2O$, $CH_2Cl_2$, etc., and/or when $KMnO_4$ is deposited on a cation exchanger by rotoevaporation. Also, the $KMnO_4$ mode of oxidation is by removing $H^+$/protons from organic compounds, for example, the oxidation of cyclohexylamine to cyclohexanone, and alcohol to ketone are well established in the literature.

Surrogate Chemical Warfare Agents (CWAs) Reaction with Mn(VII) Oxide:

Applicants' research was initiated to determine the effectiveness of Mn(VII) mineral in removing CWAs surrogates. Again, the chemistry of the these products and/or byproducts are such that they contain, N, S, P and O lone pairs of electrons which makes them suitable candidates. The testing was conducted using 2-chloroethyl ethyl sulfide (CEES), sulfur mustard analog, and dimethyl methyl phosphonate (DMMP), sarin compound analog. The use of $KMnO_4$ is again to illustrate the differences in reaction mechanisms between $KMnO_4$ and the sorbents of the invention. A 5,000 ppm of CEES solution dissolved in dichloromethane was prepared for the experiment. Two grams of $KMnO_4$, pure clay and clay-coated Mn(VII) oxide (heated to 450° C.) were added to separate conical flasks containing 20 mL of 5,000 ppm CEES. The flasks were placed in a bath maintained at 70° C. and the contents were refluxed for 3 hrs. Balloons attached to needles were placed at the top of the capped reflux units to collect trapped gases. Considerable amount of gas evolved in the Mn(VII) oxide flask within 15 min of reaction but no gas was generated in the $KMnO_4$ and clay flasks.

Figure 2A:
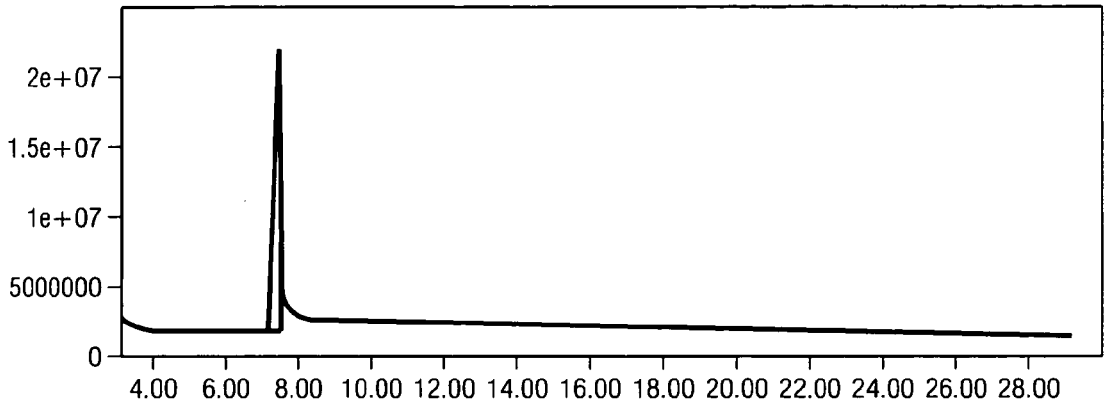
FIGS. 2(*a*)-2(*c*) are a comparison of the effectiveness of Mn(VII) oxide and $KMnO_4$ in destroying CEES compound, where 2(*a*) shows starting materials containing 5,000 ppm of 2-chloroethyl ethyl sulfide; 2(*b*) shows two grams of $KMnO_4$ reacted with 5,000 ppm of 2-chloroethyl ethyl sulfide; and 2(*c*) shows two grams of clay coated Mn(VII) oxide reacted with 5,000 ppm of 2-chloroethyl ethyl sulfide.
Figure 2B:
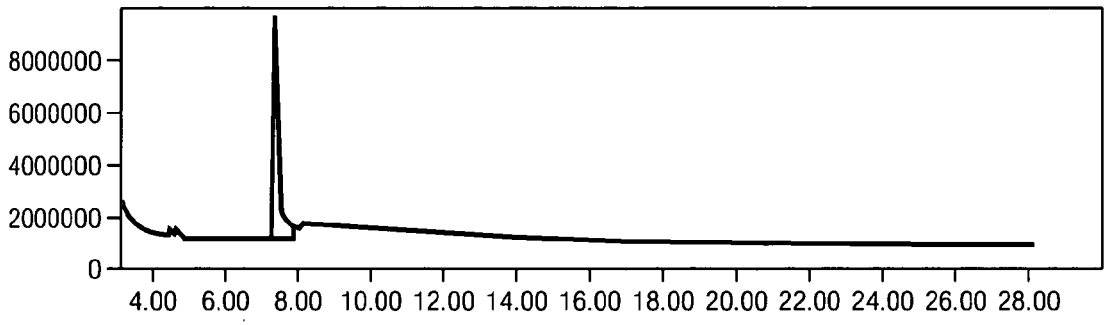
Figure 2C:
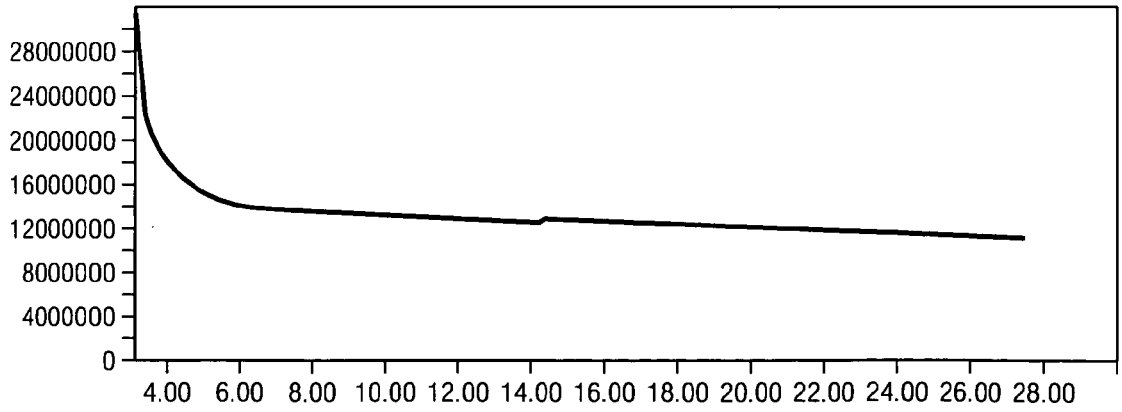
Figure 3A:
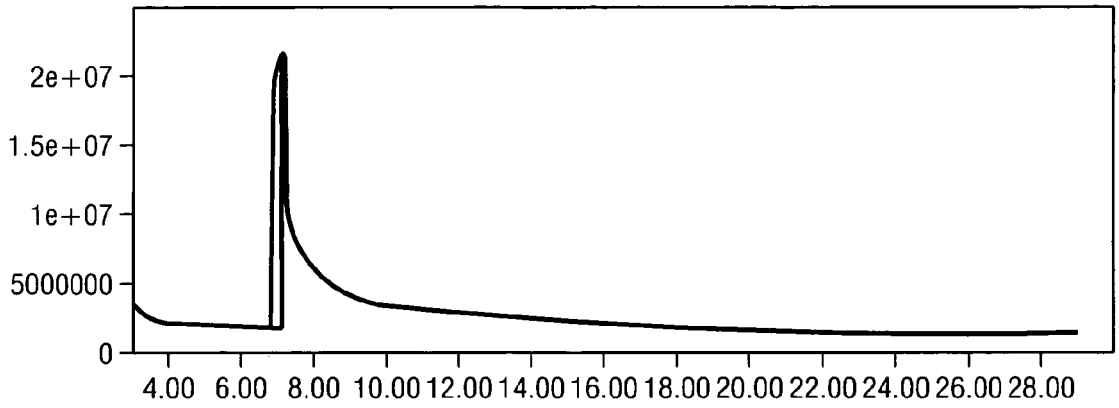
FIGS. 3(*a*)-3(*c*) are a comparison of the effectiveness of Mn(VII) and $KMnO_4$ in destroying DMMP compound, where 3(*a*) shows starting materials containing 5000 ppm of dimethyl methyl phosphonate; 3(*b*) shows two grams of $KMnO_4$ reacted with 5,000 of DMMP; and 3(*c*) shows two grams of clay coated Mn(VII) oxide reacted with 5,000 ppm of DMMP.
Figure 3B:
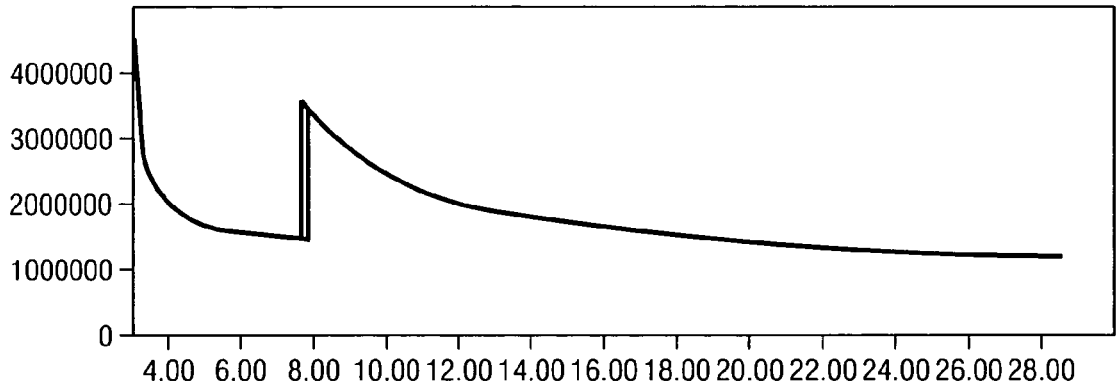
Figure 3C:
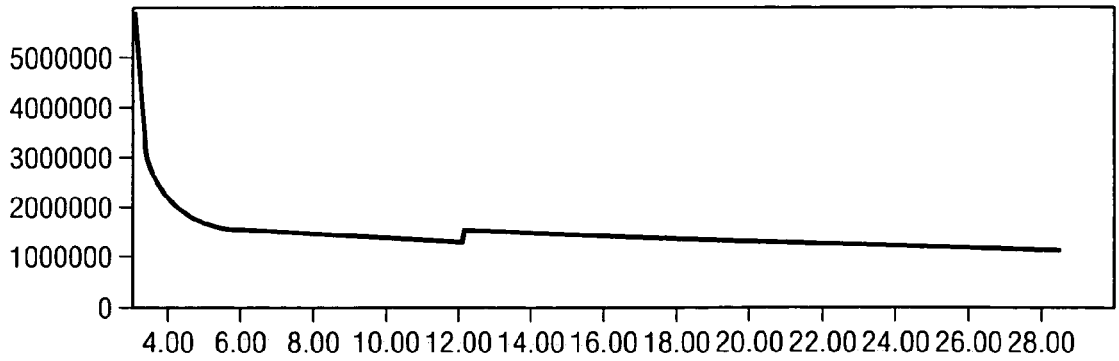

The gas chromatography and mass spectrometer (GC-MS) spectra of original starting material, $KMnO_4$ and Mn(VII) oxide reacted samples were collected. The original starting material, and clay- and $KMnO_4$-treated samples showed a peak at 7.36 min with the corresponding Mass spectrum at mass 124, indicating the presence of starting material (FIGS. 2*a* and 2*b*). The CEES reacted with clay-coated Mn(VII) oxide did not contain any GC peak indicating its complete destruction (FIG. 2*c*). The trapped gas extinguished candle light indicating the likely presence of $CO_2$ and/or CO. Similarly, when DMMP was reacted with Mn(VII) mineral and $KMnO_4$, the former destroyed the compound as evidenced by the absence of 7.09 min peak with a mass of 124 (see FIGS. 3*a*,3*b* and 3*c*). Also, the reaction of DMMP with Mn(VII) mineral produced gas. These studies demonstrate that Mn(VII) mineral is effective at oxidizing S and P based organic compounds.

Mechanism of CWAs Oxidation by Mn(VII) Mineral:

It is instructive to state that mixed Mn(III) and Mn(VII) oxide and Mn(VII) oxide attacks the lone pairs of electrons present in N, S, P and O containing organic compounds; therefore, it is effective in both aqueous and non-aqueous solvents. The CWAs and TICs contain one or more of the lone pairs of electrons, i.e., N, S, As, O, and P; therefore, Mn(VII) oxide should effectively oxidize these toxic compounds as described with respect to the Surrogate Chemical Warfare Agents discussed above.

Differences in Reaction Chemistry Between the Mn(VII) Mineral of the Invention and $KMnO_4$:

Even though $KMnO_4$ has Mn(VII) in the form of $MnO_4$ (permanganate ions), the mode of reaction is different from the proposed Mn(VII) oxide. Applicants have not discussed $Mn_2O_7$ (dimanganese heptaoxide), since this is a dangerous explosive and decomposes at temperature >55° C. Further, it has to be stored in fluorochloro compounds, e.g., $CCl_4$ for safety and stability. To date these applications have been tested to differentiate Mn(VII) mineral and $KMnO_4$ reaction mechanisms with selected compounds containing lone pairs of electrons:

1. Mn(VII) mineral degrades lone pair N containing cyclohexylamine (CHA). The reaction with $KMnO_4$ results in formation of cyclohexanone, which is also termed as an oxidation reaction because of the proton removal (Bronsted Acid).
2. Mn(VII) mineral degrades O-containing lone pair from cyclohexanone present in chemical dye industry waste streams. No reaction with $KMnO_4$.
3. Mn (VII) mineral destroy lone pair S containing 2-chloroethyl ethyl sulfide (sulfur mustard gas analog) and lone pair of electron present in dimethyl methyl phosphonate (sarin gas analog), both are simulated chemical warfare agent; therefore, Mn(VII) mineral has the ability to treat chemical weapon stockpiles and make an effective filter for protective gas masks. There is no reaction with $KMnO_4$ and pure clays.
4. Mn(VII) mineral converts hypochlorite to $Cl_2$ gas. Hypochlorite is used for household cleaning, bleaching and swimming pool cleaning. No reaction with $KMnO_4$.

ADVANTAGES OF THE INVENTION

An invention has been provided with several advantages. Advantages of Mn(VII) Oxide Technology include the below listed:

- An environmentally friendly technology is provided at a low cost.
- The product can be manufactured in aqueous and non-aqueous solvents.
- Site-specific manufacturing or safe transportation in powder or slurry form can be provided.
- The sorbents can be broadcast or sprayed over the contaminated area with warm water (40 to 50° C.) resulting in destruction of CWAs in <3 hrs.
- The products are easy to handle with no specialized equipment and with minimum supervision.
- No special containers or protocol are needed for transportation.
- The product can be manufactured in powder, slurry and aerosol forms. In slurry form, the material is highly dispersed which results in increased contact between the CWAs and surfaces, thereby improving the degradation efficiency.
- A long shelf life; the material has been stable even three years after synthesis.
- There is the possibility of adding antifreeze, glycerol, to a spray to prevent freezing.
- The product is stable at low and extremely high temperatures (>800° C.).
- The product operates in polar and non-polar solvents.
- No hazardous byproducts are anticipated; therefore, the dust or dried material either can be vacuumed or wiped with moist cloth. This in turn can be disposed of along with household garbage.
- The spent material can be disposed of in municipal landfill or domestic wastewater sewers.

Applicants' Mn(VII) mineral sorbent is a versatile material which has several possible applications for CWAs, BWAs and TICs which include:

- CWAs stockpile destruction.
- Blending in soldiers' clothing for protection against CWAs and BWAs; so as to provide greater flexibility/movement for the army to operate during terrorist attack.
- Manufacture of effective gas masks for soldiers and civilian populations.
- The destruction of CWAs and Toxic Industrial Chemicals (TICs) present in air, water, and soils, including phosgene, hydrogen cyanide, pesticides, e.g., malathion and parathion, etc.
- Incorporation into paints and coatings to design CWAs and TICs protection rooms to prevent deadly gas permeation and thus protect occupants.
- Degradation of ammunition wastes present at several Department of Defense (DoD) sites.
- Development of effective skin lotion decon against CWAs and TICs.
- Manufacture of decon spray for contaminated interior spaces, vehicles, aircrafts, sensitive equipment, etc.
- Building of optical sensors to monitor degradation of CWAs and TICs.
- Development of BWAs decon spray to destroy spores and pathogenic viruses.
- Development of a water filtration unit for drinking water supplies contaminated with CWAs and TICs.
- Developing technology for treating TICs spills, which can be utilized by Haz-Mat and Spill response teams.

While the invention has been shown in only one of its forms, it is not thus limited but is susceptible to various changes and modifications without departing from the spirit thereof.

What is claimed is:

1. A method of decontaminating surfaces exposed to chemical warfare agent, which method comprises forming an aqueous solution of $MnCl_2$; raising the pH of the $MnCl_2$ solution, thereby precipitating Mn(II) mineral; reacting the Mn(II) mineral so formed with phenylenediamine to thereby form a suspension of Mn(VII) mineral; drying the suspension of Mn(VII) mineral to produce Mn(VII) mineral product; contacting said surfaces with a sufficient amount of a reactive sorbent comprising Mn(VII) mineral which attacks the agent at Lewis Acid sites; and wherein the Mn(VII) mineral product so formed is further characterized as having a characteristic violet color and as being further characterized as being a Lewis Acid in reacting with and decontaminating chemical warfare agents, even in non-polar solvents, by attacking lone pairs of electrons donated by the chemical warfare agents being decontaminated, unlike $KMnO_4$ which acts upon organic compounds in polar solvents, which is not a Lewis Acid, and which does not act by removing lone pairs of electrons donated by chemical warfare agents; and wherein the Mn(VII) mineral product so formed is further characterized by the fact that it is not explosive at temperatures above about 55° C., as is the case with dimanganese heptoxide, but rather is stable at extremely high temperatures, such temperatures exceeding 800° C.

2. The method of claim 1, wherein said chemical warfare agent is selected from the group consisting of mustard gas, Sarin and G agents, Lewisites and cyanogen chloride.

3. The method of claim 1, wherein the Mn(VII) mineral is provided in a form selected from the group consisting of powders, liquids, slurries and aerosols.

4. The method of claim 1, wherein the Mn(VII) mineral is provided in the form of a cream or lotion for application to the human epidermis.

5. The method of claim 1, wherein the Mn(VII) mineral is supported on a solid cationic exchanger, and wherein the solid support is selected from the group consisting of clays, synthetic and natural zeolites, nanoclays and inorganic exchangers.

6. The method of claim 1, wherein the Mn(VII) mineral is synthesized as a dried product and the dried product is dispersed in an aqueous phase.

7. The method of claim 1, wherein the Mn(VII) mineral is reacted with and degrades dimethyl ethyl sulfide, a mustard gas analog.

8. The method of claim 1, wherein the Mn(VII) mineral is reacted with and degrades diethyl methyl phosphonate, a Sarin gas analog.

9. The method of claim 1, wherein the Mn(VII) mineral is synthesized as a dried product and the dried product is dispersed in a non-aqueous phase.

10. The method of claim 9, wherein the Mn(VII) product is dispersed in alcohol or any organic sorbent.

11. A method of decontaminating surfaces exposed to chemical warfare agent, which method comprises contacting said surfaces with a sufficient amount of a reactive sorbent comprising Mn(VII) mineral which attacks the agent at Lewis Acid sites; and wherein the Mn(VII) mineral is made by the process of:

forming an aqueous solution of $MnCl_2$;

raising the pH of the $MnCl_2$ solution, thereby precipitating Mn(II) mineral;

reacting the Mn(II) mineral so formed with phenylenediamine to thereby form a suspension of Mn(VII) mineral;

drying the suspension of Mn(VII) mineral to produce Mn(VII) mineral product;

wherein the Mn(VII) mineral product so formed is further characterized as having a characteristic violet color and as being further characterized as being a Lewis Acid in reacting with and decontaminating chemical warfare agents, even in non-polar solvents, by attacking lone pairs of electrons donated by the chemical warfare agents being decontaminated, unlike $KMnO_4$ which acts upon organic compounds in polar solvents, which is not a Lewis Acid, and which does not act by removing lone pairs of electrons donated by chemical warfare agents; and wherein the Mn(VII) mineral is reacted with and degrades cyclohexylamine.

12. A method of decontaminating surfaces exposed to chemical warfare agent, which method comprises contacting said surfaces with a sufficient amount of a reactive sorbent comprising Mn(VII) mineral which attacks the agent at Lewis Acid sites; and wherein the Mn(VII) mineral is reacted with and degrades cyclohexanone.

13. A method of neutralizing and/or destroying toxic industrial chemicals, which comprises forming an aqueous solution of $MnCl_2$; raising the pH of the $MnCl_2$ solution, thereby precipitating Mn(II) mineral; reacting the Mn(II) mineral so formed with phenylenediamine to thereby form a suspension of Mn(VII) mineral; drying the suspension of Mn(VII) mineral to produce Mn(VII) mineral product; contacting said industrial chemicals with a sufficient amount of a reactive sorbent comprising Mn(VII) mineral which attacks the industrial chemical by oxidation-reduction at Lewis Acid sites; and wherein the Mn(VII) mineral product so formed is further characterized as having a characteristic violet color and as being further characterized as being a Lewis Acid in reacting with and decontaminating toxic industrial chemicals, even in non-polar solvents, by attacking lone pairs of electrons donated by the industrial chemicals being decontaminated, unlike $KMnO_4$ which acts upon organic compounds in polar solvents, which is not a Lewis Acid, and which does not act by removing lone pairs of electrons donated by chemical warfare agents; and wherein the Mn(VII) mineral product so formed is further characterized by the fact that it is not explosive at temperatures above about 55° C., as is the case with dimanganese heptoxide, but rather is stable at extremely high temperatures, such temperatures exceeding 800° C.

14. The method of claim 13, wherein said toxic industrial chemical is selected from the group consisting of parathion, malathion, and related chemicals having lone pairs of electrons which can be withdrawn by Mn(VII) mineral.

15. The method of claim 13, wherein a violet colored Mn(VII) mineral is reacted with $H_2O_2$ to produce $O_2$ gas resulting in brown colored Mn(IV) mineral.

16. A method of neutralizing and/or destroying toxic industrial chemicals, which comprises contacting said industrial chemicals with a sufficient amount of a reactive sorbent comprising Mn(VII) mineral;

wherein the Mn(VII) mineral is reacted with hypochlorite to form chlorine gas and a resulting brown colored Mn(IV) mineral.

* * * * *